US008656605B2

(12) United States Patent
Parker

(10) Patent No.: US 8,656,605 B2
(45) Date of Patent: Feb. 25, 2014

(54) SYSTEM AND METHOD FOR THERMAL GRADIENT CONTROL IN THIN SHELL STRUCTURES

(75) Inventor: Richard A. Parker, Cape Elizabeth, ME (US)

(73) Assignee: Metso Paper USA, Inc., Biddeford, ME (US)

( * ) Notice: Subject to any disclaimer, the term of this patent is extended or adjusted under 35 U.S.C. 154(b) by 723 days.

(21) Appl. No.: 12/845,473

(22) Filed: Jul. 28, 2010

(65) Prior Publication Data

US 2012/0023773 A1 Feb. 2, 2012

(51) Int. Cl.
*F26B 11/02* (2006.01)

(52) U.S. Cl.
USPC ..... 34/629; 34/639; 34/640; 492/32

(58) Field of Classification Search
USPC ..... 34/618, 623, 624, 629, 639, 640; 29/455.1, 895.3, 895.22; 492/32; 162/372
See application file for complete search history.

(56) References Cited

U.S. PATENT DOCUMENTS

| | | | | |
|---|---|---|---|---|
| 3,139,375 | A * | 6/1964 | Bryand | 162/371 |
| 3,246,401 | A | 4/1966 | Walser et al. | |
| 3,259,961 | A | 7/1966 | Bryand | |
| 3,590,453 | A | 7/1971 | Bryand | |
| 3,630,838 | A | 12/1971 | Bryand et al. | |
| 3,752,639 | A | 8/1973 | Thagard, Jr. | |
| 3,781,957 | A | 1/1974 | Luthi | |
| 4,050,131 | A | 9/1977 | Bryand | |
| 4,146,428 | A | 3/1979 | Holz | |
| 4,481,722 | A | 11/1984 | Guy et al. | |
| 5,185,940 | A | 2/1993 | Fleissner | |
| 5,609,046 | A | 3/1997 | Fleissner | |
| 5,669,155 | A | 9/1997 | Hughes et al. | |
| 7,225,558 | B2 | 6/2007 | Hagen et al. | |
| 7,690,131 | B2 | 4/2010 | Mausser et al. | |
| 2005/0236339 | A1 | 10/2005 | Grace et al. | |
| 2007/0130793 | A1 | 6/2007 | Hada et al. | |

OTHER PUBLICATIONS

International Search Report with Written Opinion issued Dec. 30, 2011 for International Patent Application No. PCT/US2011/045579 (10 pages).

* cited by examiner

*Primary Examiner* — Jiping Lu
(74) *Attorney, Agent, or Firm* — Pierce Atwood LLP; Kevin M. Farrell

(57) ABSTRACT

Described herein are devices and methods for reducing thermal stresses in a rotating, foraminous thin-shelled roll for drying permeable and semi-permeable webs by blocking axial flow of heated air through an axial channel formed between two corrugated layers in the shell. The axial channels extend between spaced-apart, parallel end members each having an inner face, and a plurality of alternating straight thin divider strips and bent thin strips extending axially between and evenly-spaced around the circumference of the inner faces of the end members to form an annular cylinder with radial channels therethrough. Affixing at least one impermeable insert into a radial channel so that it extends through the radial channel and across at least a portion of the faces of the two tiers of bent strips blocks the axial channel therebetween and prevents the passage of air therethrough to the end member.

13 Claims, 8 Drawing Sheets

SYSTEM AND METHOD FOR THERMAL GRADIENT CONTROL IN THIN SHELL STRUCTURES

BACKGROUND

1. Field of the Invention

The present invention relates to the field of permeable and semi-permeable woven and non-woven web drying, and in particular to reducing thermal stresses in a Honeycomb® shell for drying such webs.

2. Discussion of Background Information

Cylindrical Honeycomb® drying rolls, such as those described by U.S. Pat. Nos. 3,259,961, 3,590,453, and 4,050,131, are well known in the art and typically these rolls are large and expensive apparatuses. The air permeable shells of such rolls comprise alternating thin straight and thin undulated strips that extend between thick metal end members, thereby effectively forming a cylindrical shell comprised of corrugated layers. The undulated strips may form, for example, half-hexagonal or triangular-shaped openings between the straight strips.

During the drying process, heated air impinges on a wet web traveling on the rotating roll. The heated process air travels through the web and between the shell openings formed by the alternating layers of straight strips and undulated strips. Sometimes, deckle bands are applied to the outer surface of the shell. Deckle bands are thin, solid strips of material that align along one edge with an end member and wrap around the entire circumference of a roll, but extend across only a small portion of the roll width. The inboard edge of a deckle band therefore defines the sheet width to be processed by the roll.

Typically, moisture in the web cools the heated air so that the temperature inside the shell is cooler than that of the heated air applied to the web. In single tier shells, this cooled but still hot air travels radially through the shell and the undulated strips prevent any axial flow within the shell structure. In dual layered shells, this cooled, but still hot, process air travels through the shell, and because of the spacing between the tiers of corrugations, air can move axially along channels formed between the two layers of corrugations, i.e. the inner diameter corrugation and the outer diameter corrugation, which are spaced apart. If the width of the traveling web is less than the width of the roll, heated air passes through the exposed shell area without any cooling. In that case, the heated process air travels through the shell at maximum temperature and some of the heated process air flows axially along channels running along the length of the roll between the layers of undulated strips. Additionally, when the traveling web sheet width does not precisely match the width of exposed roll surface area as defined by a deckle band applied to the surface of a roll, maximally heated air flows into the axial channels formed between the deckle band and the outer diameter corrugation layer and between the inner and outer corrugation layers. Thus the portion of the shell under the deckle band and adjacent to the thick metal end member connected to the shell is heated by hotter air than the portion of the roll covered by the travelling web sheet.

During the drying process, the heated air typically ranges from 250 to 550 degrees Fahrenheit and cools to 180 to 320 degrees Fahrenheit after passing through the traveling web and picking up moisture. If the sheet width of the traveling web matches shell and/or deckle width, the thin strip divider and corrugation layers at the shell ends are exposed to the same cooled air that reaches the center portion of the shell. If the sheet width, however, fails to precisely match the width of the exposed shell, either taken alone or left uncovered by the deckle band, hot supply air leaks by the end of the sheet, entering the shell and running along the axial channel between at least the layers of bent strips (i.e. the spaced apart inner diameter and outer diameter corrugation layers).

This heated process air heats the thin strips and the end members. The thick end members, therefore, are exposed to process air on one side and much cooler ambient (e.g. 70-120 degrees Fahrenheit) air on the other side, and the thin shell structure therefore operates at a significantly higher temperature than the more massive supporting end members. This temperature difference causes the support structure to exert significant restraining forces on the shell, resulting in high stress conditions at and near the connection of the thin strips of the shell and the thick end members. Furthermore, when the end members are manufactured from materials having a smaller coefficient of thermal expansion than that of the thin strips, these stresses at the connection between the elements are exacerbated. The thin straight and undulated strips absorb heat and expand more rapidly than the thick metal end members. This causes a sharp thermal gradient at the intersection of the thin strips and thick end members and these steep thermal gradients cause high stresses. The magnitude of the temperature difference, the thermal gradient and the differences in coefficients of thermal expansion are all major factors the affect stress levels at and near the connection between the divider and end ring.

Similarly, thermal stresses occur during sudden warm up or cool down of a roll. To avoid such stresses, warm up and cool down durations are often extended so that the thin metal strips and end members absorb heat and cool more evenly and more gradually, thereby reducing the slope of the thermal gradient. This adds time and inefficiency to the overall manufacturing process for drying travelling webs.

A need therefore exists for a device that blocks axial airflow between layers of undulated strips forming at least a dual layered Honeycomb® shell and therefore reduces the thermal gradient between the shell and the end members, thereby reducing cycle fatigue and extending the useful life of the production roll.

SUMMARY OF THE INVENTION

The present invention solves the above-stated problems associated with axial airflow of both maximally heated and moisture cooled process air.

In one embodiment, the present invention comprises a rotating, foraminous thin-shelled roll for drying permeable and semi-permeable webs. The thin-shelled roll comprises a pair of spaced apart, parallel end members each having an inner face, and a plurality of alternating straight thin divider strips and bent thin strips extending axially between and evenly-spaced around the circumference of the inner faces of the end members to form an annular cylinder. The bent, undulated strips define radial channels along the length of the adjacent divider strips for receiving air therethrough, thereby providing the foraminous characteristic of the thin shelled roll.

In one embodiment, this foraminous wall of the cylindrical shell comprises two spaced-apart tiers of bent strips disposed between the straight strips and an axial channel extends between the two tiers of bent strips from one end member to the other. In this embodiment, at least one impervious thin strip deckle band is disposed about the surface of the annular cylinder and aligned at one fixed edge with an end member, thereby reducing the width of the foraminous area of the thin shelled roll. Additionally, at least one impermeable insert is aligned at and/or near the free edge of impervious thin strip deckle band and extends through a radial channel and across the entire axial channel and at least a portion of the faces of the two tiers of bent strips so as to block the axial channel therebetween and prevent the passage of air therethrough to the end member.

BRIEF DESCRIPTION OF THE DRAWINGS

One will better understand these and other features, aspects, and advantages of the present invention following a review of the description, appended claims, and accompanying drawings:

DETAILED DESCRIPTION

The present invention solves the thermal stress problems associated with foraminous, rotating thin shelled dryers for drying permeable and semi-permeable woven and nonwoven webs to produce sheet materials.

Figure 1A:
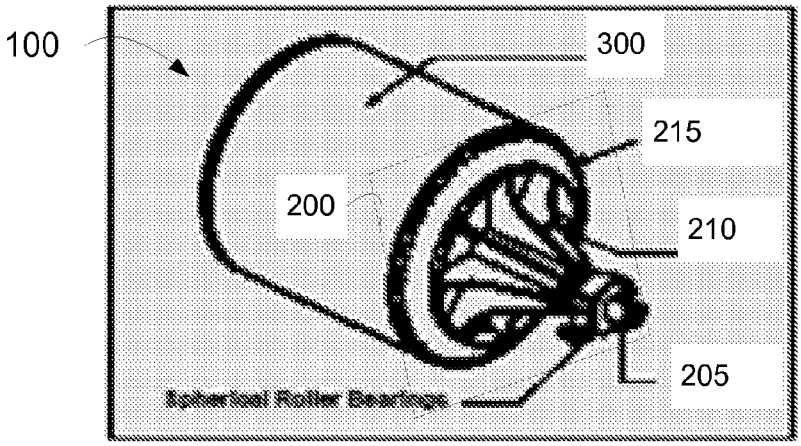
FIG. 1A depicts a schematic of one embodiment of a typical Thru-Air® dryer.

FIGS. 1A through 4C depict portions of an embodiment of a Thru-Air® brand through air dryer shell. FIG. 1A depicts a typical rotating cylindrical dryer shell system 100 comprising end members 200 supporting a foraminous cylindrical shell 300 on both ends. One embodiment of an end member 200 comprises a journal 205 about which the cylindrical shell 300 rotates, and a head 210 joining an end ring 215 to the journal. The end ring 215 supports the shell 300 and typically is manufactured from a durable metal capable of withstanding a manufacturing environment, such as but not limited to carbon steel or stainless steel. The thicknesses of the end ring 215 and head member 210 are many times far greater than that of the thin strips of material forming the dividers 305 and corrugations 310 of the shell 300. The thin strip dividers 305 and corrugations 310 typically range from 0.030 to 0.125 inches thick and most applications fall within the narrower included range of 0.055 to 0.095 inches. By comparison, the end rings 215 are manufactured of much thicker stock, and may be several inches thick.

Figure 1B:
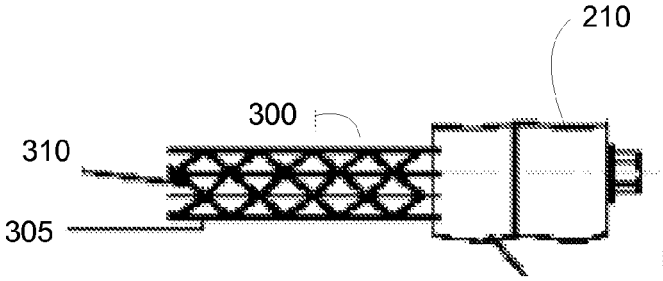
FIG. 1B depicts a schematic of one embodiment of the thin strip shell components of a typical Thru-Air® dryer.
Figure 1C:
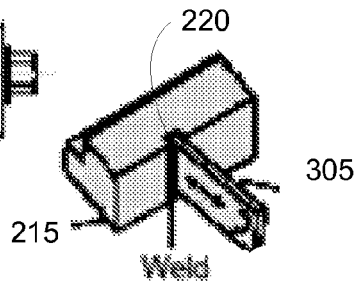
FIG. 1C depicts a schematic of a close up cross section of a portion of the embodiment of FIG. 1B.
Figure 2A:
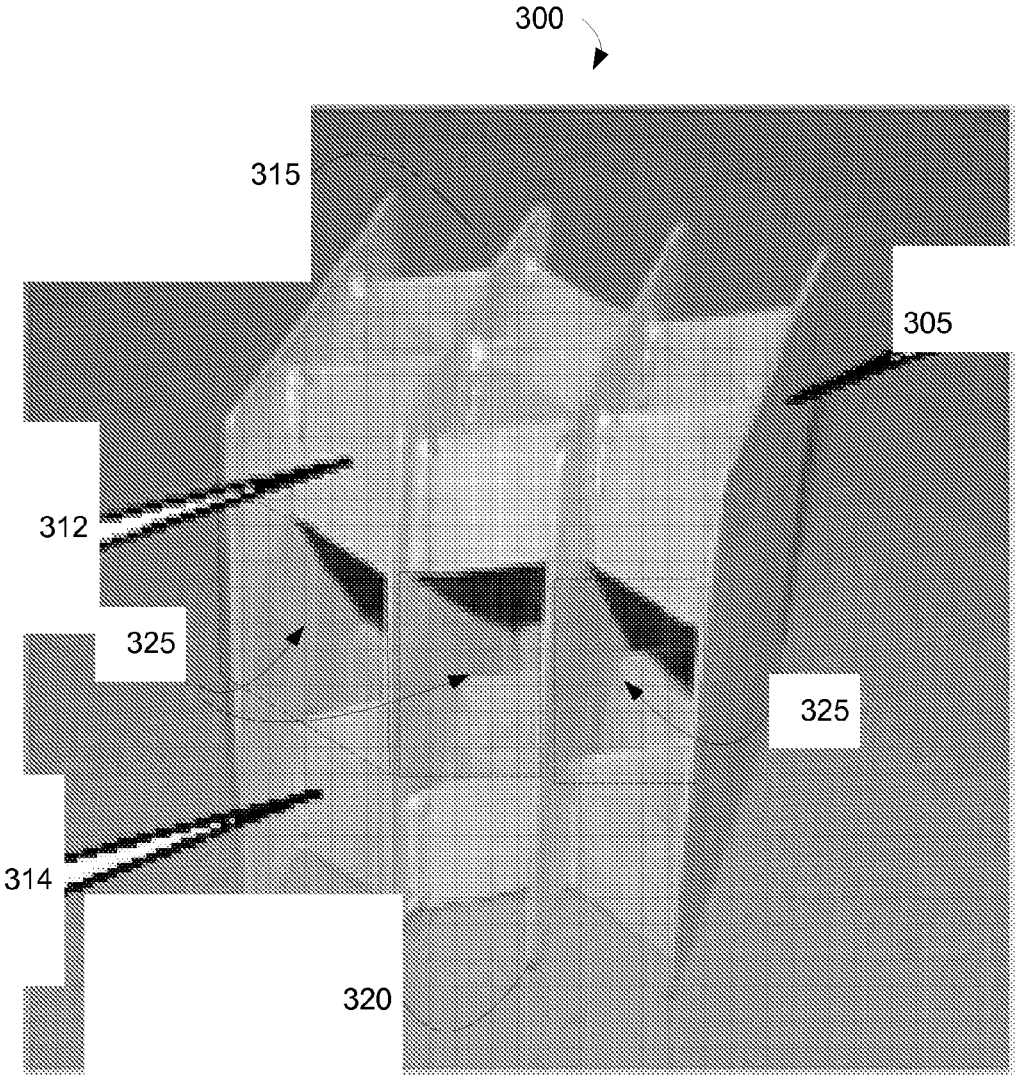
FIG. 2A is a perspective end view of one embodiment of a dual tiered shell section of a Thru-Air® dryer.
Figure 2B:
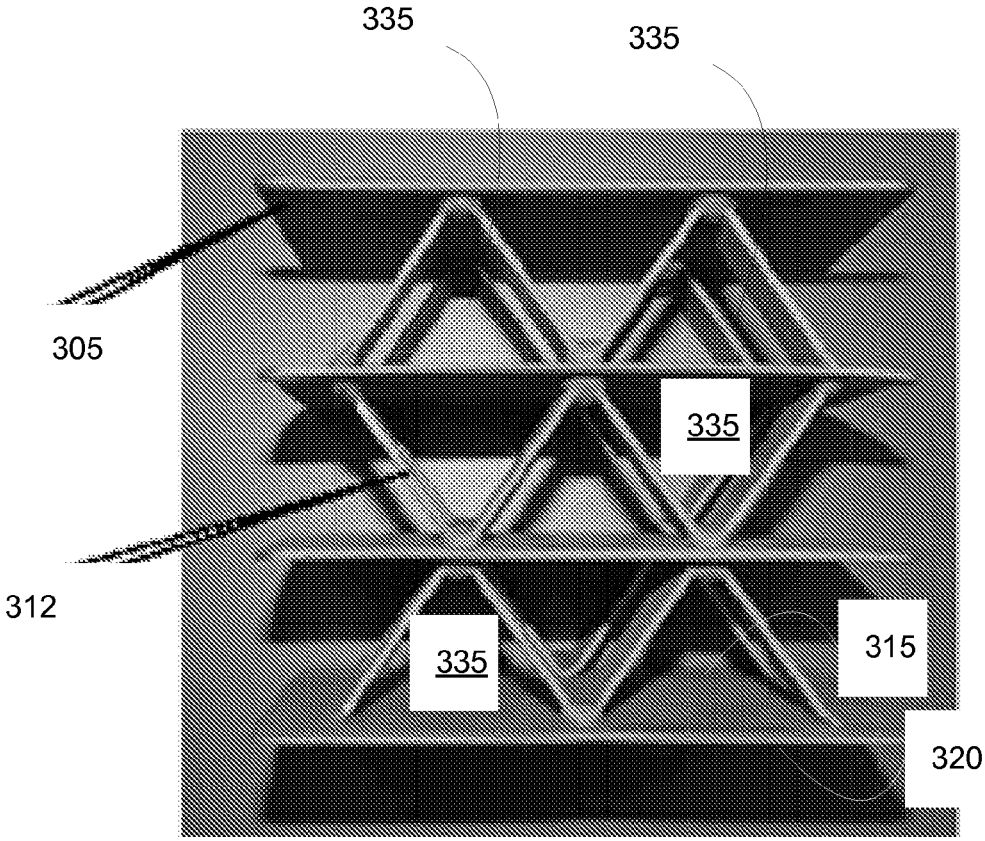
FIG. 2B is a top view of one embodiment of FIG. 2A.

One embodiment of the foraminous shell 300 is depicted in the shell cross section top view of FIG. 1B. FIGS. 1B and 1C depict cross section schematics of one end of one embodiment of the shell 300, which comprises alternating layers of thin straight strips forming dividers 205 and thin bent, undulated strips forming corrugations 310 between the dividers. The bends in the corrugations 310 define the radial gaps through which airflow is channeled by the shell 300. Here, the corrugations form a triangular undulation. In other embodiments, the corrugations may form half hexagons or any other shape that simultaneously provides the shell 300 with structural strength and sufficient permeability and channeling of airflow therethrough. As FIG. 1C depicts, each divider intersects and joins with an end ring 215 on both ends of the shell 300 such that each divider extends between and terminates at the end members 200 of a dryer shell system 100. In one embodiment, each divider sits within a recess 220 in each end ring 215 and is secured by some mechanical means such as but not limited to welds, rivets, press fit, reflow, or any other method of securement capable of withstanding the shear forces, hoop and moment forces, and thermal stresses applied to the joint between these two structural members.

In some embodiments, the corrugations 310 may be two tiers deep. For example, in the embodiments of FIGS. 2A and 2B, the shell 300 comprises an outer diameter corrugation 312 disposed near an outer surface 315 and an inner diameter corrugation 314 disposed near an inner surface 320 of the shell 300. The outer diameter corrugation 312 and inner diameter corrugation 314 are spaced apart to form an axial channel 325 therebetween. When subjected to heated process air 330, the radial channels 335 formed by the corrugations 312, 314 enable airflow therethrough so that any wet sheet 340 traveling thereon is dried by the heated air passing therethrough. Process air also travels axially along the axial channel 325 as depicted by the arrows in FIGS. 4A and 4B, but by design, the process air flowing axial through the channel 325 presumably passes through a wet sheet 340 and cools significantly by wicking and evaporative drying of the web.

Figure 3A:
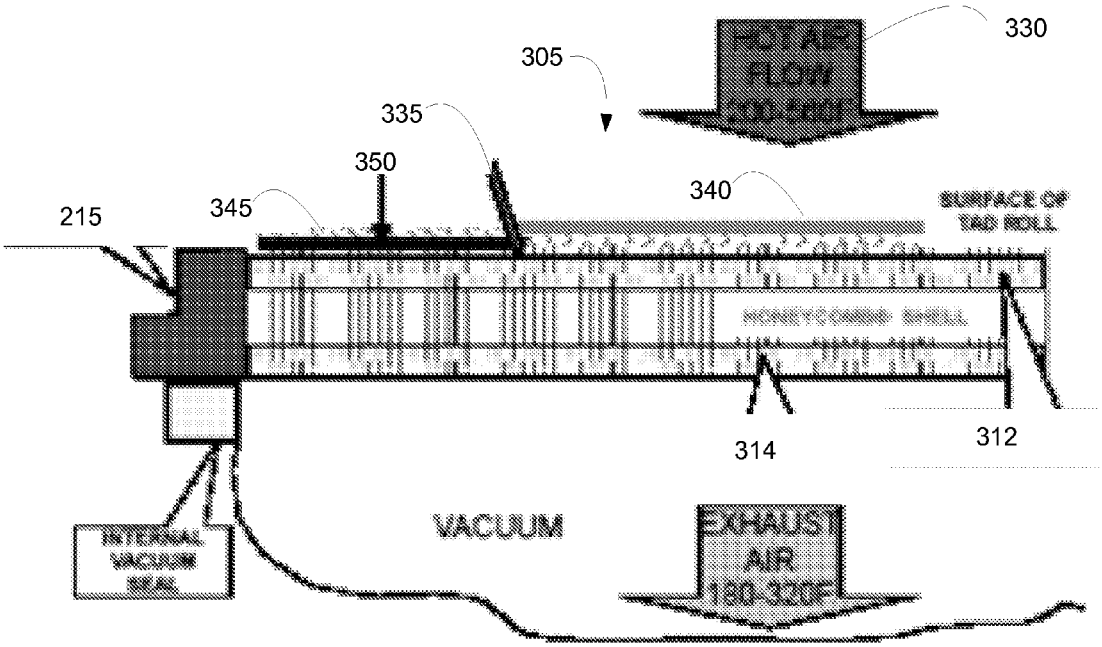
FIG. 3A depicts a schematic of one embodiment of a cross section of a Thru-Air® dryer in use.
Figure 3B:
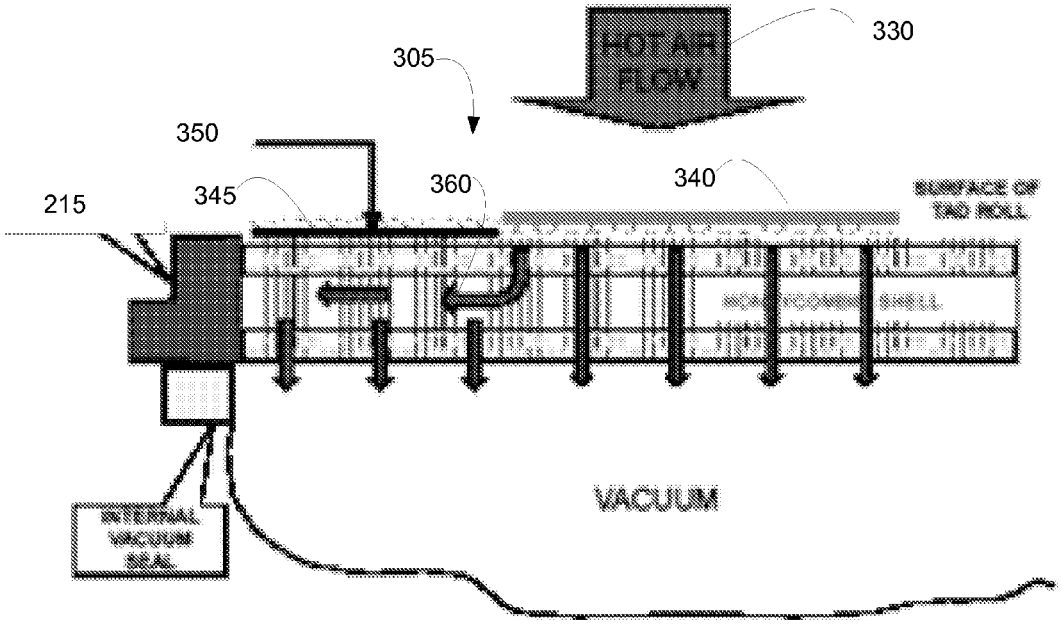
FIG. 3B depicts a schematic of one embodiment of a cross section of a Thru-Air® dryer in use.

FIGS. 3A and 3B depict a cross section of the shell cut horizontally along the axis of the shell and vertically along the same axis to show one divider and two layers of corrugation 310 thereon. As FIGS. 3A and 3B indicate, heated process air 330 impinges upon a wet sheet 340, i.e. a web of woven and/or non woven fibers, traveling on the rotating foraminous shell, typically with a fabric layer 345 therebetween. Heated process air 330 may be, for example, 200-560 degrees Fahrenheit. The heated process air 330 travels through the wet sheet 340, picks up moisture from the sheet and exits the shell at an exhaust temperature of, for example, 180-320 degrees Fahrenheit. The moisture in the wet sheet 340 therefore cools the heated process air 330, and reduces the amount of thermal stress caused by heated air travelling axially along the channel 325 between the inner diameter corrugation 314 and the outer diameter corrugation 312. The reduction in temperature of the process air 300 typically defines the limit of the temperature difference between the shell 300 and massive end rings 215. The axial flow pushes this maximum temperature closer to the end rings 215 thereby increasing the gradient.

In some embodiments, a thin strip, impervious deckle band 350 encircles the shell 300. This limits the permeable width of shell 300 to match the width of the sheet 340 and therefore limits the flow of hot process air near the connection of the shell 300 and the end ring 215. As FIG. 3A indicates at diagonal arrow 355, a portion of the heated process air 330 sometimes bypasses the sheet 330, particularly if the sheet 330 fails to directly abut the deckle band 350. This portion of heated process air 330 indicated by diagonal arrow 355.

Figure 4A:
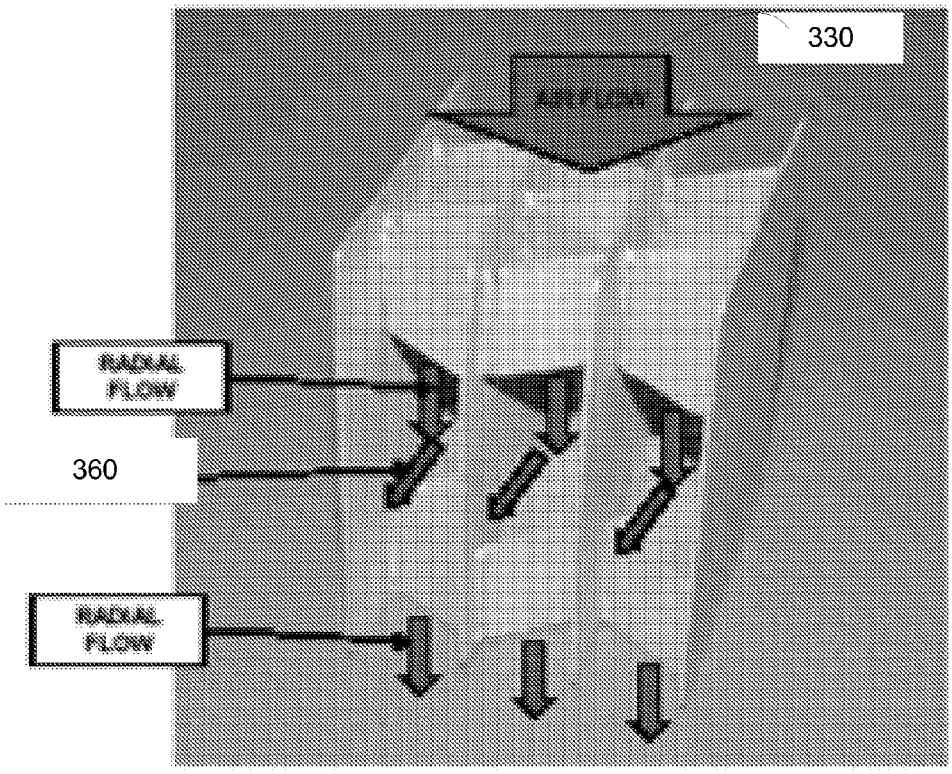
FIG. 4A depicts a perspective side view of airflow through one embodiment of a dual tiered shell section of a Thru-Air® dryer.
Figure 4B:
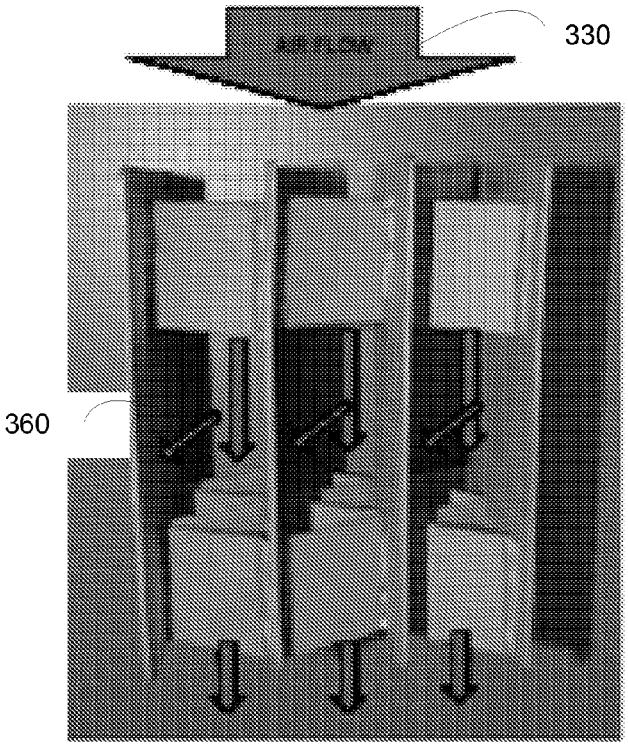
FIG. 4B depicts a top view of airflow through the embodiment of FIG. 4A.

Curved arrows 360 in FIG. 3B clearly indicate the axial flow of heated process air 330 along the channel 325 and out to the end ring 215. FIGS. 4A and 4B further depict axial airflow arrows 360 indicating axial airflow of heated process air moving through a cross section of the shell 300. This "leak-by" exposes the shell under the deckle band 350 to a higher temperature than would normally occur, and hence causes the thermal gradient to be greater than if no "leak-by" occurred.

Figure 5A:
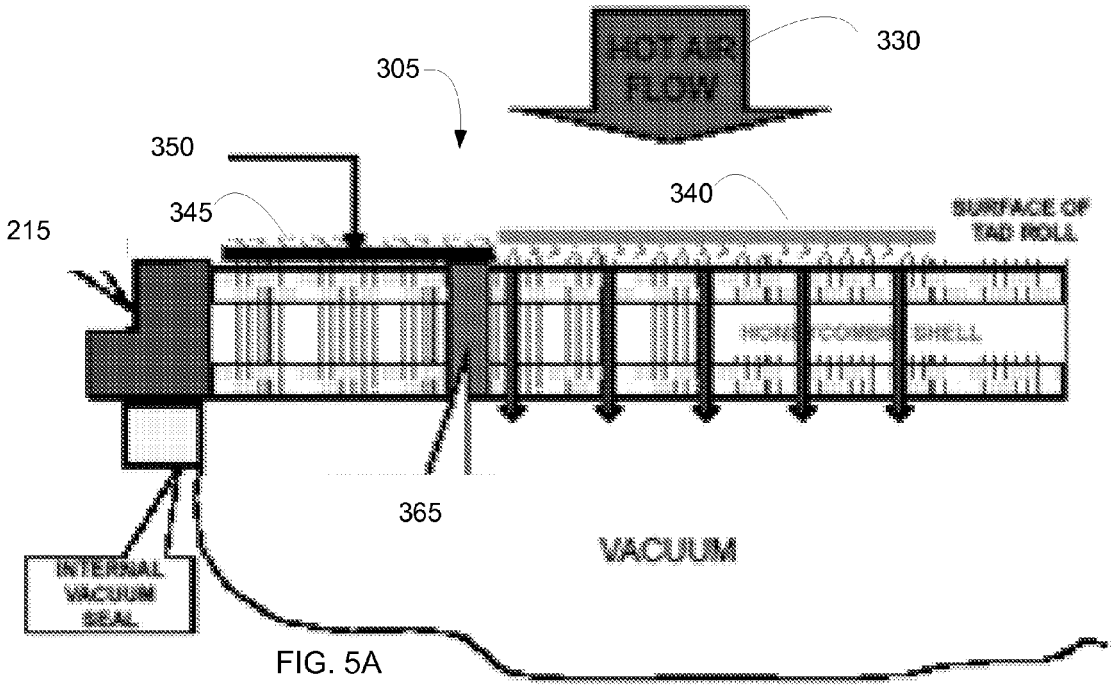
FIG. 5A depicts the view of FIG. 1B with one embodiment of the present invention installed.
Figure 5B:
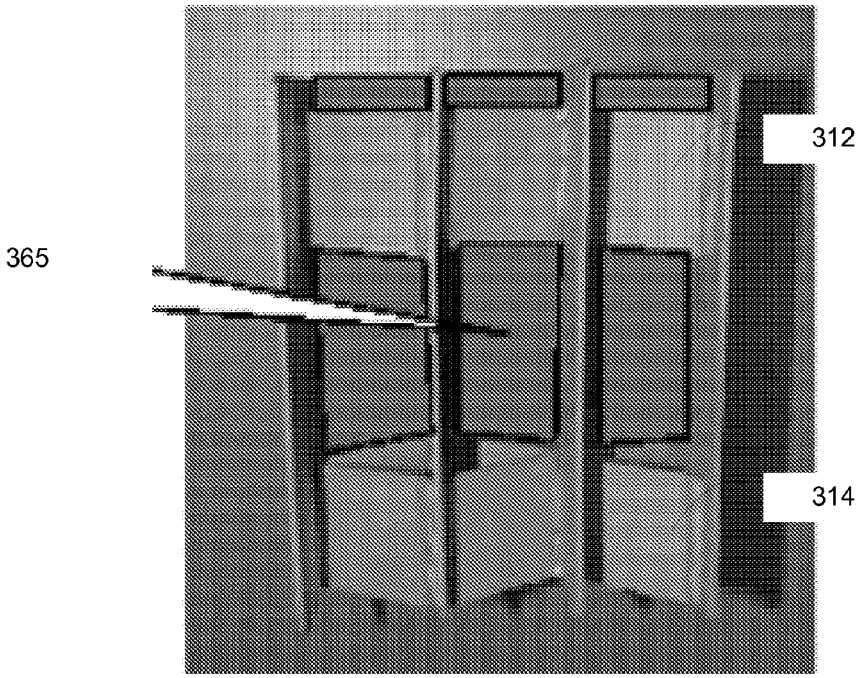
FIG. 5B depicts the view of FIG. 4B with one embodiment of the present invention installed.

The present invention blocks the axial airflow 360 by sealing the axial channel 325 inboard of the sheet edge of the deckle band 350. As FIGS. 5A and 5B indicate, in one embodiment, a blocking plate 365 is secured to the inner diameter corrugation 314 and the outer diameter corrugation 312, thereby blocking the axial channel 325 therebetween. The blocking plate 365 may be a thin sheet of steel secured to the corrugation layers 310 by some permanent fastening means such as but not limited to welds, rivets, screws, reflow, and clamps. Preferably, the thin sheet of steel is laid to rest in against the parallel faces of the corrugations 312, 314 and welded to the inner diameter corrugation layer 314 and outer diameter corrugation layer 312 such that the physical and thermal forces applied to the rotating shell cannot dislodge the blocking plate 365 and such that the thin blocking plate 365 only negligibly fills the radial channel 335 so that airflow therethrough is uninterrupted. In one embodiment a blocking plate 365 is inserted across every axial channel 325 around a full circumference of the shell 300 so that no heated air moves axially through the shell 300 between the blocking plates 365 and the end member. In one embodiment, the blocking plates 365 are aligned with the inboard edge (side closest to the centerline of the shell 300) of the deckle band 350 so as to prevent any "leak-by" under the deckle band 350.

By using a thin metal plate as the blocking plate 365, the present invention provides opportunity for subsequent modification of a shell 300. Through air rolls 100 typically are expensive, custom made systems. If a user opts to dry a sheet width that varies from the original design of a shell, the deckle band 350 can be removed completely or removed and replaced with a smaller band or a larger band. Alternatively, the width of the deckle band 350 may be augmented by the addition of another band matched edge to edge. In any of these cases, altering the location of a thin strip blocking plate 365 is possible. Because, in this embodiment, the existing blocking plates 365 are thin strips of metal, e.g. less than or equal to 0.125 inches, and do not significantly block radial flow through the shell 300, the blocking plates 365 can be removed and repositioned or and new blocking plates 365 may then be inserted into one or more radial channels 335 at a desired location.

Figure 6A:
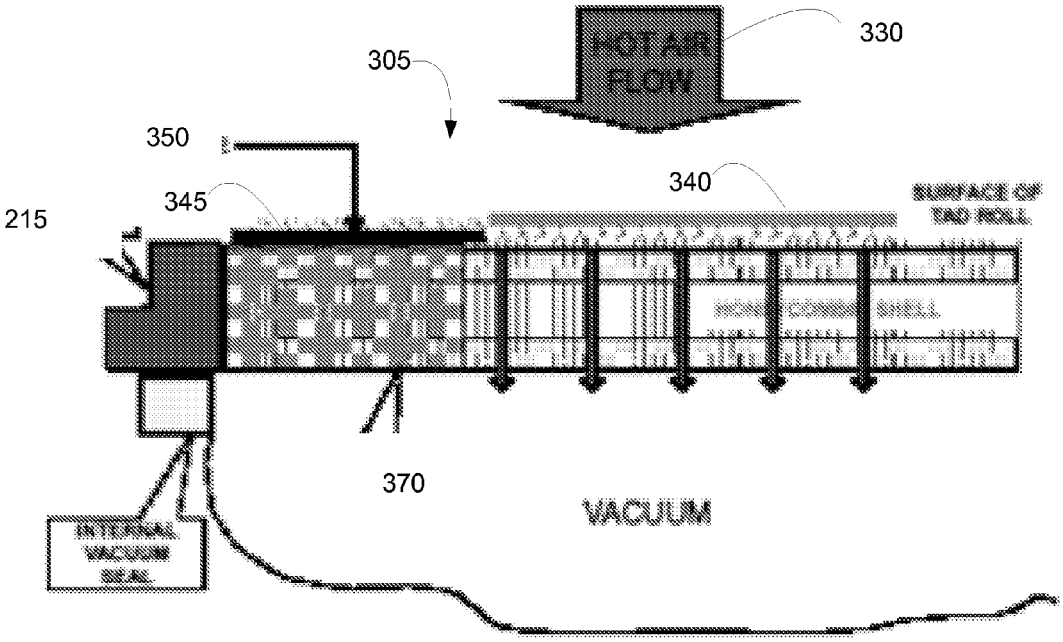
FIG. 6A depicts the view of FIG. 1B with another embodiment of the present invention installed.
Figure 6B:
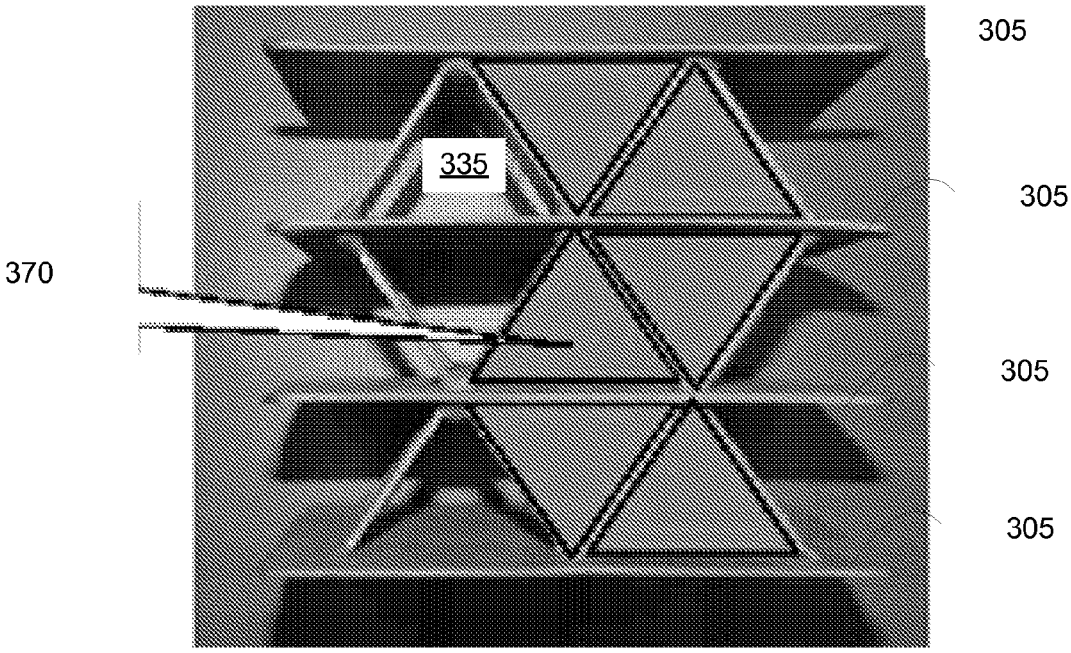
FIG. 6B depicts the view of FIG. 2B with one embodiment of the present invention installed.
Figure 6C:
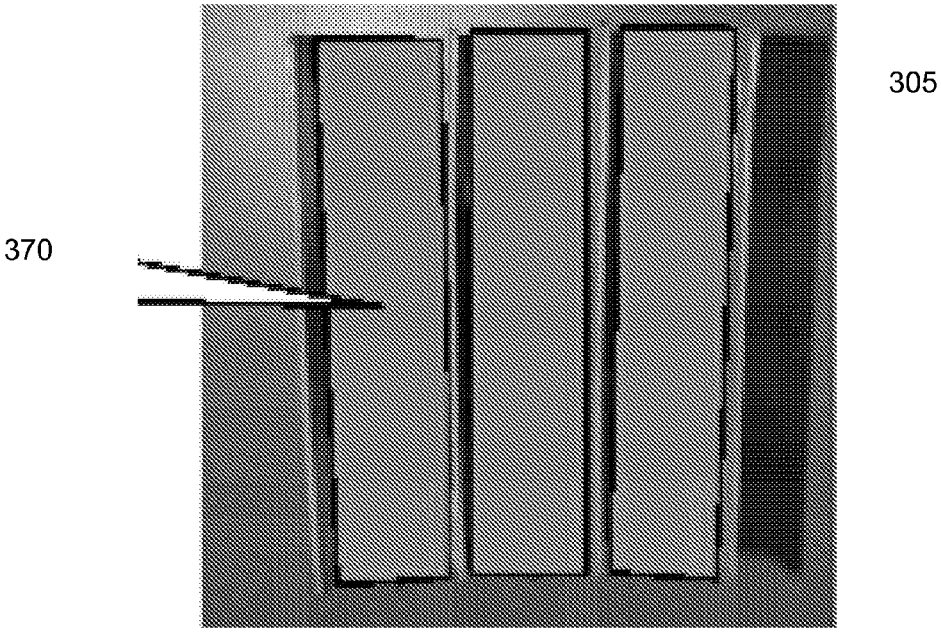
FIG. 6C depicts the view of FIG. 4B with one embodiment of the present invention installed.

In another embodiment depicted in FIGS. 6A through 6C, radial openings are completely filled with a cast insert 370 at a location between the end ring 215 and the edge of the deckle band 350. Like the embodiment of the blocking plates 365, the cast insert 370 is inserted into radial openings around a full circumference of the shell 300 aligned with the sheet edge of the deckle band 350 so that axial flow is blocked from flowing axially through the channel 325 to the end ring 215. The cast insert 370 can be made of rubber, metal, ceramic or any other material but preferably has a low compressive resistance and coefficient of thermal expansion compatible with the material(s) of the shell 300. Using such a material ensures that the material offers negligible resistance to the normal thermal expansion and contraction of the shell 300 and end ring 215.

Although this embodiment is more permanent that the metal blocking plates 365 embodiment, the cast insert 370 blocks the axial flow of air and also insulates the dividers 305 from direct contact with heated air. The divider temperature, and subsequently the thermal gradients along the divider 303 and between the divider 305 and end ring 215, therefore are driven almost exclusively by conduction in the divider 305 and corrugations 312, 314. In another embodiment, several layers of radial channels along the width of the shell 300 may be filled with cast inserts 370 as indicated for example in FIG. 6A. This increases the amount of cast material available for heat absorption and further reduces the thermal gradient within the dividers 305 and between the dividers 305 and end ring 215. Heat conduction is a slower and more gradual heat transfer process as compared to direct heat transfer between unimpeded heated air and the thin metal strips forming the dividers 305 and corrugations 312, 314 of the shell 300. Because the air exiting the shell 300 is kept further away from the end ring 215, the thermal gradient between the end ring and the shell 300 is reduced, thereby reducing stress. Conduction results in a much slower heating process which supports a lower thermal gradient between the thin strip dividers 305 and the thick end rings 215 and minimal thermal expansion of the thin strip dividers 305.

In other embodiments, further control over thermal gradient within the shell 300 and between the shell 300 and the end ring 215 is achieved by extending the sheet edge of the deckle band 350 further out from the end ring 215 and repositioning the blocking plates 365 and/or cast material 370 blocking the axial channel 325. In these embodiments, the width of the shell 300 may require enlargement to accommodate a required production sheet width, but enlarging the distance between the end ring 215 and the blocking plates 365 and/or cast material 370 lessens the severity of the thermal gradients and reduces the stress in the roll 100 and its constituent components.

Controlling the airflow and heat transfer near the connection of the dividers 305 and the end rings 215 reduces the stress levels between the dividers 305 and the end rings 215, thereby prolonging the useful life of the roll 100. Blocking plates 365 and cast inserts 370 block the axial channel 325 from heated airflow therethrough and extend the life of the shell by reducing fatigue. Fatigue is proportional to the number of usage cycles multiplied by the cubed value of the stress range. Therefore, reducing the thermal stress range exponentially increases the useful life of the roll 100 by reducing the amount of fatigue. During the design process for a roll 100, factors considered include heated temperature ranges, the number of start up and shut down processes, sheet loss incidents during which the shell is exposed to heated process air when a sheet comes off of a rotating roll 100, an estimated number of emergency stops, etc. Factors such as the rate of warm up and cool down of a roll 100 typically are controlled by extending the processing time involved in these procedures. By reducing or eliminating the stresses caused by axial airflow of heated process air 330, the present invention decreases the time required to warm up and cool down a shell 300. This improves overall process efficiency in addition to protecting the elements of the shell 300 from fatigue. The present invention therefore improves process efficiency and extends the fatigue life of a through air roll by reducing thermal stresses.

It is noted that the foregoing examples have been provided merely for the purpose of explanation and are in no way to be construed as limiting of the present invention. While the present invention has been described with reference to an exemplary embodiment, it is understood that the words, which have been used herein, are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

I claim:

1. A rotating, foraminous thin shelled roll for drying permeable and semi-permeable webs comprising:

a) a pair of spaced apart, parallel end members, each having an inner face, b) a plurality of alternating straight thin divider strips and bent thin strips extending axially between and evenly-spaced in a circle around the inner faces of the end members to form an annular cylinder having a longitudinal axis, wherein:

i. the bent strips define radial channels along the length of the adjacent divider strips for receiving air therethrough, thereby providing the foraminous characteristic of the thin shelled roll, ii. the foraminous wall of the cylinder comprises two tiers of bent strips disposed between the straight strips, and iii. an axial channel extends concentrically along the longitudinal axis between the two tiers of bents strips from one end member to the other;

c) at least one impervious thin strip disposed about the surface of the annular cylinder and aligned at one fixed edge with an end member, thereby reducing the width of the foraminous area of the thin shelled roll; and d) at least one impermeable insert aligned at and/or near the free edge of the impervious strip and extending through a radial channel and across the entire axial channel and at least a portion of the faces of the two tiers of bent strips so as to block the axial channel therebetween completely and prevent the passage of air therethrough to the end member.

2. The thin shelled roll of claim 1, further comprising at least one impermeable insert disposed in every radial channel around the circumference of the cylinder that is aligned at or near the free edge of the impervious strip.

3. The thin shelled roll of claim 1 wherein the impermeable insert is a steel plate affixed to the parallel faces of the two tiers of bent strips.

4. The thin shelled roll of claim 1 wherein the impermeable insert is cast into the radially oriented channels formed by the corrugations aligned at and/or near the edge of the impervious strip.

5. The thin shelled roll of claim 1 wherein each end member is manufactured from a material having a first coefficient of thermal expansion.

6. The thin shelled roll of claim 5 wherein the at least two dividers are manufactured from a material having a second coefficient of thermal expansion that is greater than the first coefficient of thermal expansion.

7. The thin shelled roll of claim 5 wherein the at least two dividers are manufactured from a material having a second coefficient of thermal expansion that is less than the first coefficient of thermal expansion.

8. A method of manufacturing a rotating, foraminous thin shelled roll for drying permeable and semi-permeable webs comprising:

a) providing a pair of spaced apart, parallel end members, each having an inner face, b) providing a plurality of alternating straight thin divider strips and bent thin strips extending axially between and evenly-spaced in a circle around the inner faces of the end members to form an annular cylinder having a longitudinal axis, wherein:

i. the bent strips define radial channels along the length of the adjacent divider strips for receiving air therethrough, thereby providing the foraminous characteristic of the thin shelled roll, ii. the foraminous wall of the cylinder comprises two tiers of bent strips disposed between the straight strips, and iii. an axial channel extends concentrically along the longitudinal axis between the two tiers of bents strips from one end member to the other;

c) providing at least one impervious thin strip disposed about the surface of the annular cylinder and aligned at one fixed edge with an end member, thereby reducing the width of the foraminous area of the thin shelled roll; and d) affixing at least one impermeable insert aligned at and/or near the free edge of impervious strip and extending through a radial channel and across the entire axial channel and at least a portion of the faces of the two tiers of bent strips so as to block the axial channel therebetween completely and prevent the passage of air therethrough to the end member.

9. The method of claim 8 further comprising affixing at least one impermeable insert at every radial channel around the circumference of the cylinder that is aligned at or near the free edge of the impervious strip.

10. The method of claim 8 wherein the impermeable insert is a steel plate affixed to the parallel faces of the two tiers of bent strips.

11. The method of claim 8 wherein the impermeable insert is cast into the radially oriented channels formed by the corrugations aligned at and/or near the edge of the impervious strip.

12. The method of claim 8 wherein each end member is manufactured from a material having a first coefficient of thermal expansion.

13. The method of claim 12 wherein the at least two dividers are manufactured from a material having a second coefficient of thermal expansion that is greater than the first coefficient of thermal expansion.

* * * * *